US005572894A

United States Patent [19]

Yano

[11] Patent Number: 5,572,894

[45] Date of Patent: Nov. 12, 1996

[54] DIE FOR EXTRUDING ELONGATE ARTICLES HAVING LONGITUDINAL ORIFICES

[75] Inventor: Sadahide Yano, Osaka, Japan

[73] Assignee: Yugen Kaisha Yano Engineering, Osaka, Japan

[21] Appl. No.: 360,927

[22] Filed: Dec. 21, 1994

[30] Foreign Application Priority Data

Dec. 27, 1993 [JP] Japan ..... 5-331385

[51] Int. Cl.[6] ..... B21C 25/04

[52] U.S. Cl. ..... 72/269; 72/478

[58] Field of Search ..... 72/260, 264, 269, 72/478

[56] References Cited

U.S. PATENT DOCUMENTS

| | | | |
|---|---|---|---|
| 439,986 | 11/1890 | Tracy | 72/260 |
| 2,964,178 | 12/1960 | Goldsmith et al. . | |
| 4,138,871 | 2/1979 | Kawano et al. | 72/269 |
| 4,377,085 | 3/1983 | McDermott et al. | 72/269 |
| 5,131,253 | 7/1992 | Hopkins | 72/269 |

FOREIGN PATENT DOCUMENTS 0223909 6/1986 European Pat. Off. .

OTHER PUBLICATIONS

Patent Abstracts of Japan, vol. 17, No. 365 (M–1442), Jul. 9, 1993 of JP 5057337 (Showa Alum. Corp.), Mar. 9, 1993.

Patent Abstracts of Japan, vol. 13, No. 318 (M–852), Jul. 19, 1989 of JP 1104412 (Showa Alum. Corp.), Apr. 21, 1989.

*Primary Examiner*—Lowell A. Larson

*Attorney, Agent, or Firm*—Armstrong, Westerman, Hattori, McLeland & Naughton

[57] ABSTRACT

A die (1) has a thin rod-shaped mandrel (2) tightly surrounded by the segments (11) of a gripper (3), the mandrel (2) being placed in the axial bore (5) of a mandrel holder (4). The inner peripheral surface of the axial bore (5) is shrinkage-fitted or otherwise fixedly fitted on outer peripheral surfaces of the gripping segments (11), thereby urging them to keep the thin rod-shaped mandrel (2) in place in the holder (4). The mandrel can have an extremely fine orifice forming end (9) of a diameter of 3 mm or less, such an fine can be prepared easily and precisely, and maintenance of the die can be done inexpensively when the orifice forming end will have been worn out or damaged.

6 Claims, 10 Drawing Sheets

DIE FOR EXTRUDING ELONGATE ARTICLES HAVING LONGITUDINAL ORIFICES

BACKGROUND OF THE INVENTION

1. Field of the Invention

The present invention relates to a die for extruding elongate articles made of a metal such as aluminum and having longitudinal orifices.

2. Description of the Prior Art

An example of the prior art dies 71 is shown in FIG. 10, which has been used to extrude elongate articles 'E' of aluminum or the like metal and each having a longitudinal orifice 'h' as shown in FIG. 9A, 9B or 9C.

This die 71 of the port-hole type is an die assembly consisting of a male die 72 and a female die 73 combined therewith. The male die 72 has an orifice former 74 needle-shaped and protruding forwards. This orifice former 74 integral with the male die is to be located within a forming hole 75 of the female die 73 combined with the male die 72. The extrudate 'E' extruded through this die 71 will have an outer periphery corresponding to the inner periphery of the forming hole 75 of the female die 73, with the orifice former 74 thereby producing the longitudinal orifice 'h' extending through the extrudate.

However, it has not been easy even for the electrospark machining to make such an orifice former 74 integral with the male die 72 in those prior art dies, especially where said former 74 must be of high precision in shape and dimension.

It has been almost impossible to prepare a highly precise orifice former 74 that could form an extremely thin orifice 'h' having a diameter for example of 3 mm or less.

Further, it has been another problem that a male die 72 must be replaced entirely with a new one even when only the orifice former 74 would be worn.

OBJECTS OF THE INVENTION

An object of the present invention made in view of such drawbacks is therefore to provide a die of a novel type for extruding elongate articles having longitudinal orifices, wherein the die of novel type can comprise without any difficulty a fine orifice former that is highly precious and has been difficult to prepare, and wherein maintenance of the die can be done inexpensively when its orifice former will have been worn out.

Other objects and advantages of the present invention will become apparent from its embodiments described below. The embodiments setting forth some preferable modes are not intended to delimit the invention, but can be modified within the spirit and scope thereof.

SUMMARY OF THE INVENTION

A die provided herein to extrude elongate articles each having a longitudinal orifice does comprise a thin rod-shaped mandrel having an orifice forming portion, a gripper composed of gripping segments each shaped to fit tightly and sideways on the mandrel, and a mandrel holder having an axial bore for receiving and holding the gripper, with the mandrel tightly surrounded by the segments of the gripper being placed in the axial bore of the mandrel holder, wherein an inner peripheral surface of the axial bore is shrinkage-fitted, interference-fitted or otherwise fixedly fitted on outer peripheral surfaces of the gripping segments, thereby urging the segments to keep the thin rod-shaped mandrel in place.

The die may further comprise key pieces each held by and between forward and rearward shoulders, with the forward shoulder facing a rear end of the gripper and formed in the inner peripheral surface of the axial bore, and the rearward shoulder being formed in the outer peripheral surface of each gripping segment and at an intermediate region thereof so as to face a front end of the gripper, whereby the gripper is immovably and correctly positioned in the axial bore.

The thin rod-shaped mandrel has a lug protruding sideways and resting on the rear end surface of the gripper, thereby correctly positioning the mandrel relative to the gripper.

In another mode of the invention, a die to extrude elongate articles each having a longitudinal orifice does comprise a plurality of thin rod-shaped mandrels each having an orifice forming portion, a plurality of grippers each composed of gripping segments shaped to fit tightly and sideways on the mandrel, and a mandrel holder having a plurality of axial bores for receiving and holding the grippers, with each mandrel tightly surrounded by the segments of the corresponding gripper being placed in the corresponding axial bore of the holder, wherein an inner peripheral surface of each axial bore is shrinkage-fitted or otherwise fixedly fitted on outer peripheral surfaces of the gripping segments, thereby urging the segments to keep each thin rod-shaped mandrel in place.

In still another mode of the invention, the die to extrude elongate articles each having two or more longitudinal orifice does comprise a plurality of thin rod-shaped mandrels each having an orifice forming portion, a gripper composed of gripping segments each shaped to fit tightly and sideways on the mandrels, and a mandrel holder having an axial bore for receiving and holding the gripper, with the mandrels each tightly surrounded by the segments of the gripper being placed in the axial bore of the holder, wherein an inner peripheral surface of the axial bore is shrinkage-fitted or otherwise fixedly fitted on outer peripheral surfaces of the gripping segments, thereby urging the segments to keep the thin rod-shaped mandrels in place.

In each mode of the invention, the mandrel having the orifice forming portion is one of discrete constituents of the die. Therefore, the thin rod-shaped mandrel of any desired small diameter defining the orifice can be prepared easily and precisely.

In manufacture of such a die, the mandrel tightly surrounded by the gripping segments will be placed at first in the axial bore of the holder. Subsequently, the inner peripheral surface of the axial bore will be shrinkage-fitted or otherwise fixedly fitted on the outer peripheral surfaces of the gripping segments. Thus, a centripetal force will be imparted to the segments, which will consequently keep the thin rod-shaped mandrel of any small diameter to be integral with the holder.

Even if the diameter of the orifice forming portion is extremely small and for example less than 3 mm, the mandrel having such a fine portion can now be prepared easily and precisely.

Maintenance cost for the die of the novel type is reduced, because only the abraded mandrel need be replaced with a new one.

The key pieces secured to the gripper and supported between the annular shoulders facing one another are effective to easily and correctly position the gripper within the axial bore of the mandrel holder, thereby facilitating the manufacture of the die in its entirety.

The sideways lug is effective to position the thin rod-shaped mandrel correctly relative to the gripper, also facilitating the manufacture of the die.

It is preferable in the invention to employ both the positioning mechanisms, one comprising the key pieces and the other comprising the sideways lug, so that the die can be manufactured most easily and most correctly.

DETAILED DESCRIPTION OF THE PREFERRED EMBODIMENT

Some embodiments of the invention will now be described.

Figure 9A:
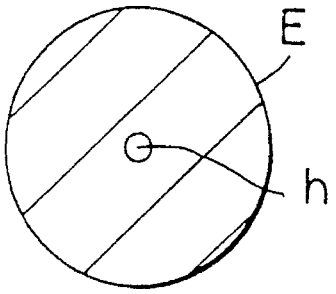
FIGS. 9A to 9C are cross sections of a variety of elongate articles extruded through the die provided herein.

A die provided in a first embodiment is used to extrude an aluminum elongate and columnar article 'E' having a round axial orifice 'h' as shown in FIG. 9A.

The die 1 shown in FIGS. 1 to 5 comprises a thin rod-shaped mandrel 2 secured in a gripper 3 which in turn is held by a die holder 4. The reference numerals 5, 6 and 7 respectively denote an axial bore, key pieces and a sideways lug. The further numeral 8 denotes a rear cover for the mandrel.

The mandrel 2 serving to form the axial orifice 'h' extending longitudinally of the elongate article 'E' is a thin rod round in cross section. The mandrel may be prepared using a die steel or a hard material such as a hard metal in any known manner to have a diameter of 3 mm or less, e.g., 0.3 mm. The mandrel 2 may however be of a larger or smaller diameter, depending on that of the orifice 'h' to be formed. Although the mandrel is uniform in cross section over its full length, at least an orifice forming portion 9 thereof, that is a frontal tip end in this embodiment, need be designed in conformity with the orifice 'h'.

The sideways lug 7 fixed to the mandrel at a portion thereof adjacent to a rear end serves to correctly position the mandrel relative to the gripper. In this embodiment, the lug 7 is a donut-shaped collar 7*a* having a central hole through which the rear end of the mandrel is inserted. The mandrel is soldered, for example silver-brazed to the collar. Alternatively, the rear end of mandrel may be caulked to form a sideways protrusion to take place of the lug 7.

Figure 2:
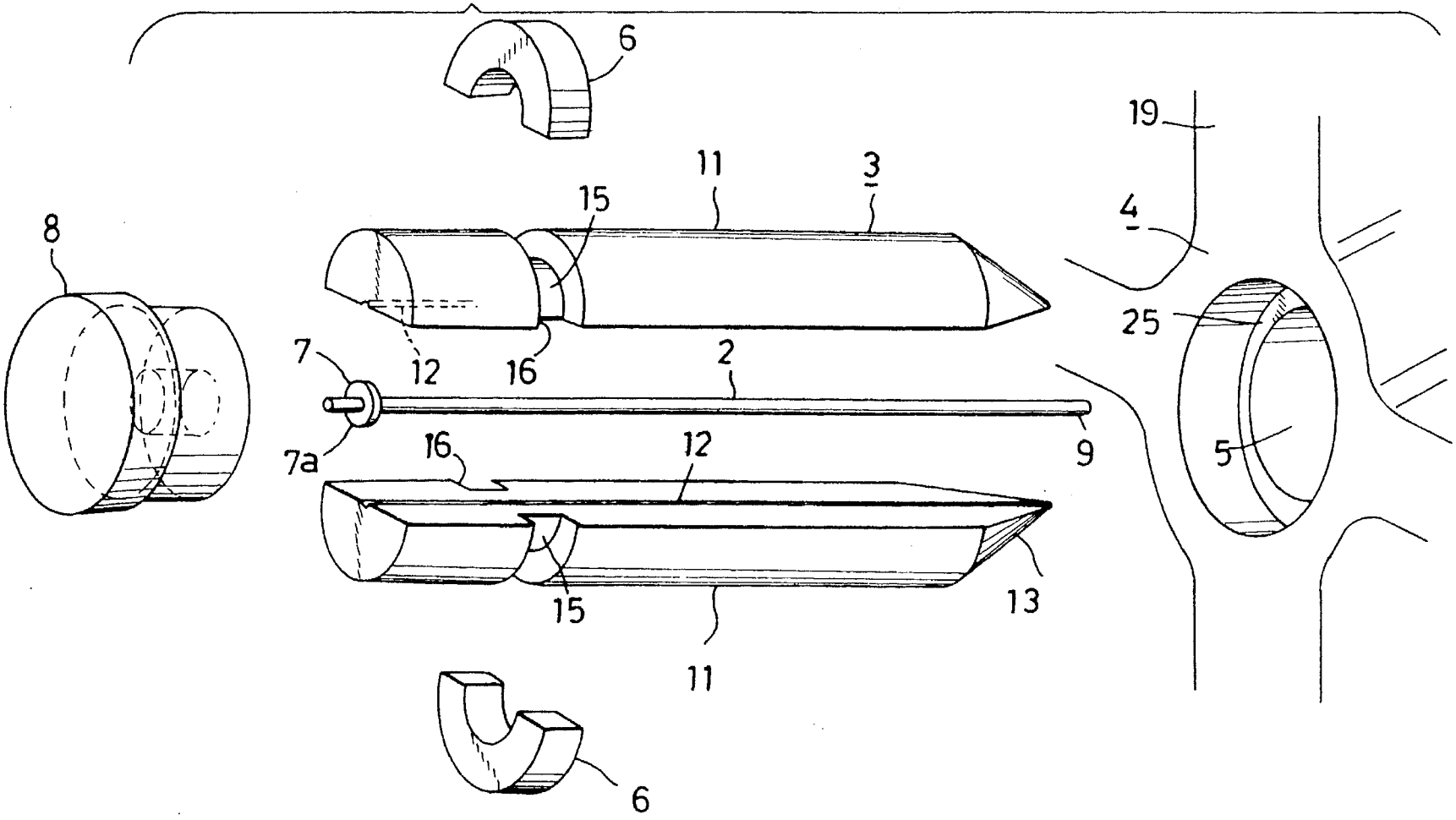
FIG. 2 is a perspective view of a male die constituting the die shown in FIG. 1, and having its constituents disassembled.

The gripper 3 made of a hard material such as a hard metal (viz. cemented carbide) or ceramics is composed of a pair of semicylindrical gripping segments 11 and 11, as seen in FIG. 2. Those segments 11 have flat sides that are adjoined one to another to provide the generally columnar gripper.

A narrow groove 12 is formed in the flat side of each gripping segment 11, centrally and longitudinally over its full length. The grooves 12 each being semicircular in cross section are complementary to assume a round axial bore extending through the gripper. Therefore, the gripping segments 11 may be brought sideways into contact with each other at their flat sides so that their grooves 12 fit on the mandrel 2. With such gripping segments 11 urged towards each other, the mandrel 2 will be prevented from slipping off the gripper 3 longitudinally thereof.

Figure 3:
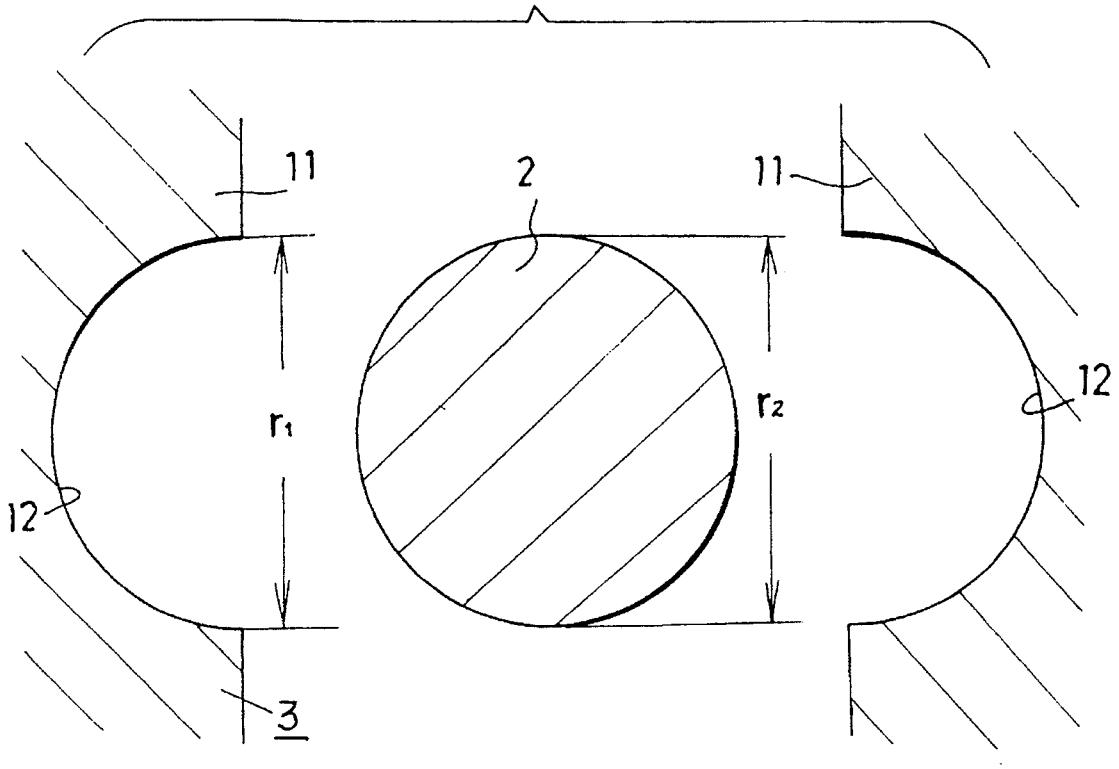
FIG. 3 is an enlarged cross section of a thin rod-shaped mandrel and fine grooves formed in gripping segments, all included in the male die.

For this purpose, the diameter $r_1$ of each groove 11 is designed slightly smaller than that $r_2$ of the mandrel, as shown in FIG. 3. For example, $r_2$ is larger than $r_1$ by about 1% thereof.

Figure 1:
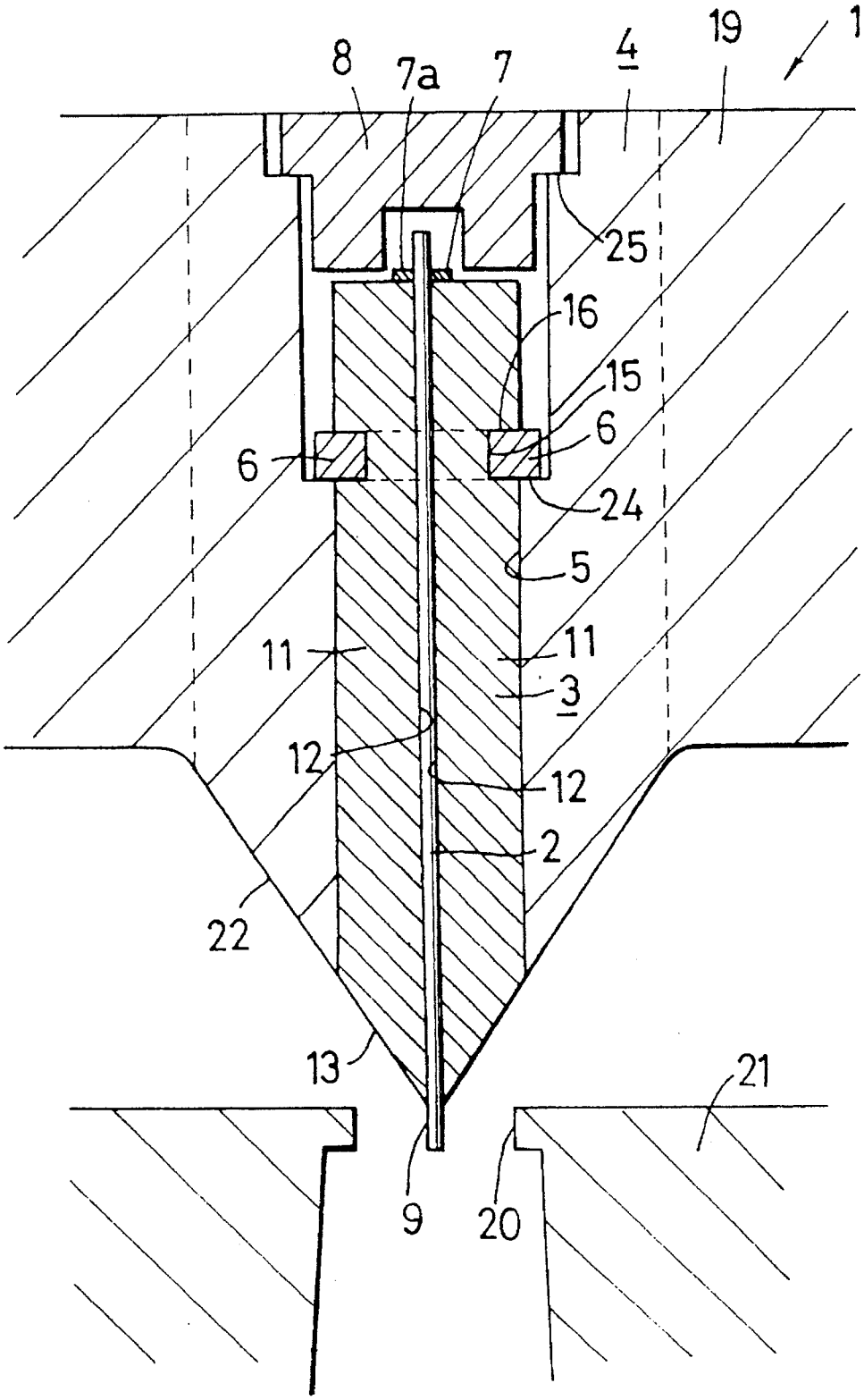
FIG. 1 is an enlarged cross section of a principal portion of a die for extruding elongate articles each having a longitudinal orifice, the die being provided in a first embodiment of the invention.

As seen in FIG. 1, the gripper 3 is of a length such that the frontal tip as the orifice forming portion 9 of the mandrel 2 protrudes a certain distance forwardly of the front end of the gripper 3, when the sideways lug 7 secured to the rear portion of the mandrel 2 is supported by the rear end of said gripper.

The front end of the gripper 3 columnar and composed of the coupled segments 11 is of a conical shape adapted to control the flow of a material that is being extruded through this die.

Each gripping segment 11 has at its portion near the rear end a semicircular groove formed in its outer periphery and generally U-shaped in cross section so that an annular groove 15 is provided for the gripper 3 when its segments 11 mate one another. A circular wall of the groove 15 serves as a rearward shoulder 16 facing the frontal end of the gripper 3.

The key pieces 6 surrounding the gripper are semi-donut-shaped members fitting in the gripper's annular groove 15, as shown in FIG. 2. An inner periphery of each key piece 6 contacts a bottom of the groove, and an outer periphery of each key piece protrudes sideways from the gripper 3.

The cross-sectional shape of the straight groove 12 formed in each gripping segment 11 may be modified in any manner, insofar as the thin rod-shaped mandrel 2 slip off the gripper 3. The number of the gripping segments 11 need not necessarily be 2 (two), but 3 (three) or more arranged in a circular direction.

Figure 4A:
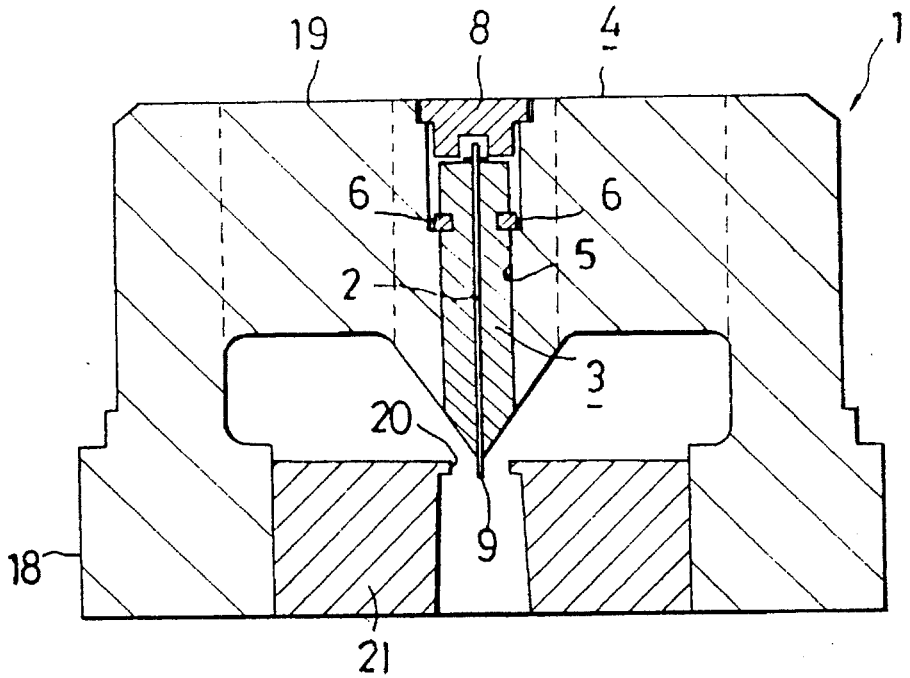
FIG. 4A is a vertical cross section of the die shown in its entirety.
Figure 4B:
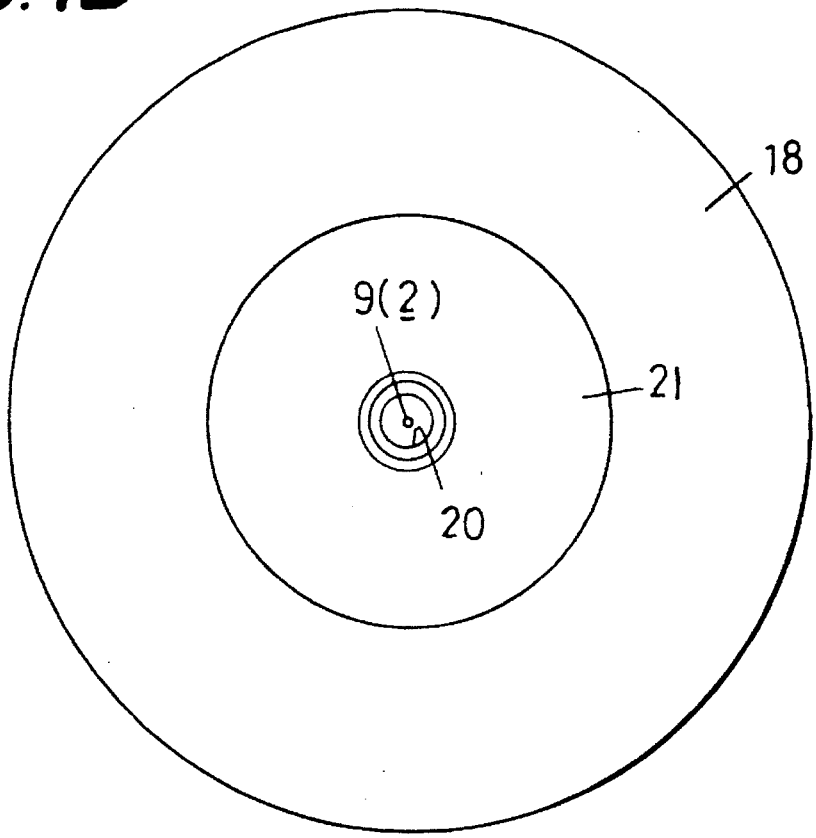
FIG. 4B is a bottom view of the die shown in its entirety.
Figure 5:
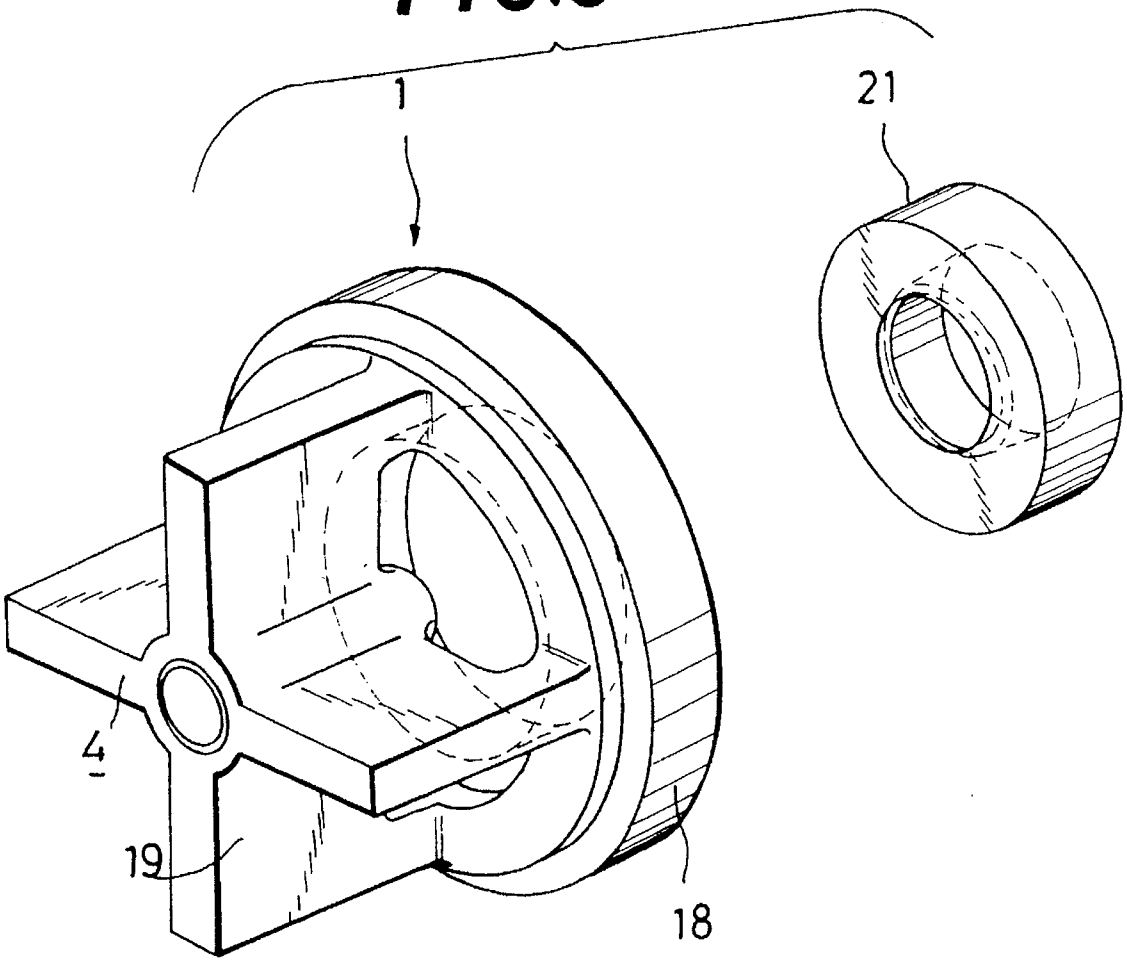
FIG. 5 is a perspective view of a principal member of the male die separated from a female die which is to be combined therewith.

The mandrel holder 4 is made of a die steel which has a different thermal expansion coefficient from that of the gripper 3. FIGS. 4A to 5 illustrate the holder comprises an annular base portion 18 integral with a bridge portion 19. The latter portion 19 protrudes rearwardly from the former portion 18, and is generally of a cruciform shape.

A female die 21 also made of a hard material such as hard metal or ceramics fits in the base portion 18 of the mandrel holder. A forming hole 20 penetrates the female die, centrally and axially thereof.

The axial bore 5 penetrates the cruciform bridge portion 19, also centrally and axially thereof as shown in FIGS. 1 and 4A. A cross-sectional contour of the axial bore is round and has the same size as the gripper 3.

A central front end 22 of the bridge portion 19 is a frustum for control of the flow of the material being extruded. An opening of the axial bore 5 is located in the frustum-shaped end of the bridge portion.

A rearward region of the axial bore 5 is of an expanded diameter so that a rearward annular shoulder 24 is provided to face the rear end of the holder. Thus, an outer frontal surface of each key piece 6 fitted in the annular groove 15 bears against the rearward shoulder. In this state of the gripper 3, its conical front end 13 has an outer surface smoothly continuing to that of the frustum-shaped end 22 of the mandrel holder's bridge portion 19.

The rearmost region of the axial bore 5 is further stepped behind the said annular shoulder 24, so as to provide an annular seat 25 for the mandrel cover 8.

In manufacture of this die, the segments 11 of the gripper 3 will be positioned to engage with each other in a manner suggested in FIG. 2. Those segments are then brought close sideways to the thin rod-shaped mandrel 2 such that it fits in their straight grooves 12, with the rear lug 7 being supported on the rear surface of the gripper 3. In this way, the mandrel 3 is set at its correct position longitudinally of the gripper 3, so that the orifice forming end 9 of said mandrel protrudes a predetermined distance forwardly from said gripper.

Subsequently, the key pieces 6 will be placed in the annular groove 15 formed in the gripper's rear portion so that their inner concave surfaces bear against the grooves's bottom. Next, the gripper will be inserted into the axial bore 5 from its rear opening, until the key pieces' outer convex portions rest on the annular shoulder 24. Thus, the gripper 3 will be set at its correct longitudinal position relative to the mandrel holder 4, with the conical end of the former's bridge portion 19 continuing smoothly to frustum end of the latter. As a result, the mandrel 2 takes its correct position relative to the holder 4 and the mandrel's orifice forming end 9 protrudes forwardly therefrom a predetermined correct distance. This order of assembling those parts may be modified so long as their relative positions described above are ensured.

Finally, the female die 21 will be placed in the annular base 18 of the mandrel holder 4, before shrink-age-fitted or otherwise rigidly fixed thereto to finish this assembly of composite die 1. In the thus finished die 1, the inner periphery of the holder's axial bore 5 always urges the outer periphery of the gripper 3 centripetally towards the mandrel 2 so as to strongly retain it at its correct position in the holder 4. Therefore, the mandrel's orifice forming end 9 is kept at its position protruding a predetermined distance into the forming hole 20 of the female die 21, which is shrinkage-fitted to and integral with the annular base 18.

As will be understood from the foregoing, the orifice forming end 9 of the thin rod-shaped mandrel 2 as one of discrete parts of the composite die is tightly held by the gripper 3 which is shrinkage-fitted to and integral with the mandrel holder 4. Therefore, such an extremely fine orifice-forming end 9 can easily incorporated in the composite die, in a precise manner to improve the durability thereof.

Thanks to the described structure in which the orifice forming end 9 is a member independent from other members in the die, the mandrel 2 having such an end 9 can readily be replaced with a new one when it becomes worn out or damaged due to a repeated operation for hours or due to troubles. The repairing of the die can thus be effected only by changing the worn or damaged mandrel, thereby reducing the maintenance cost for said die.

Figure 6A:
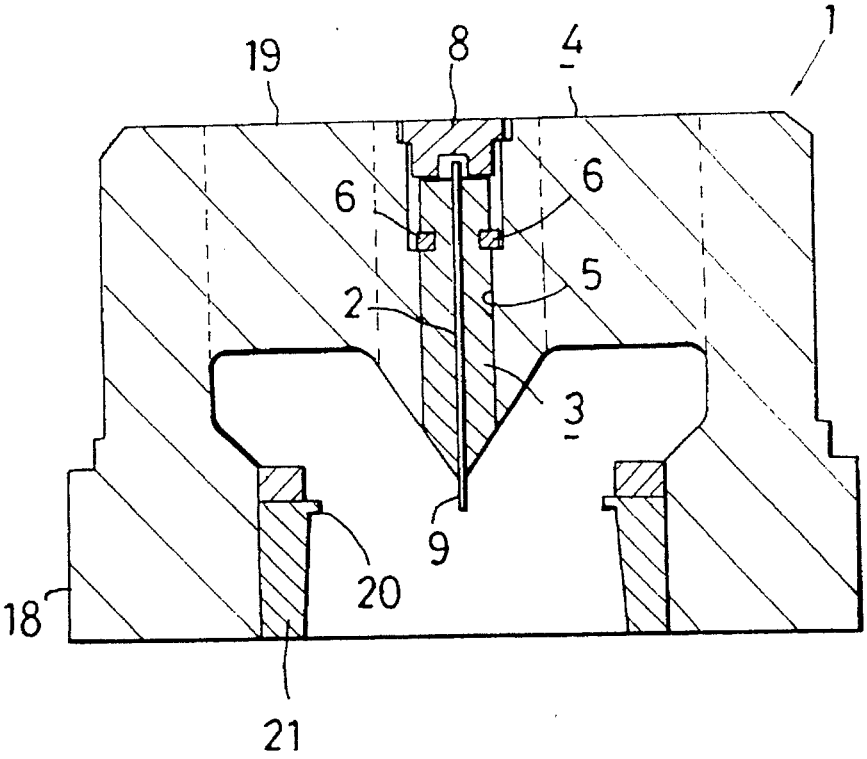
FIG. 6A is a vertical cross section of another die provided in a second embodiment.
Figure 6B:
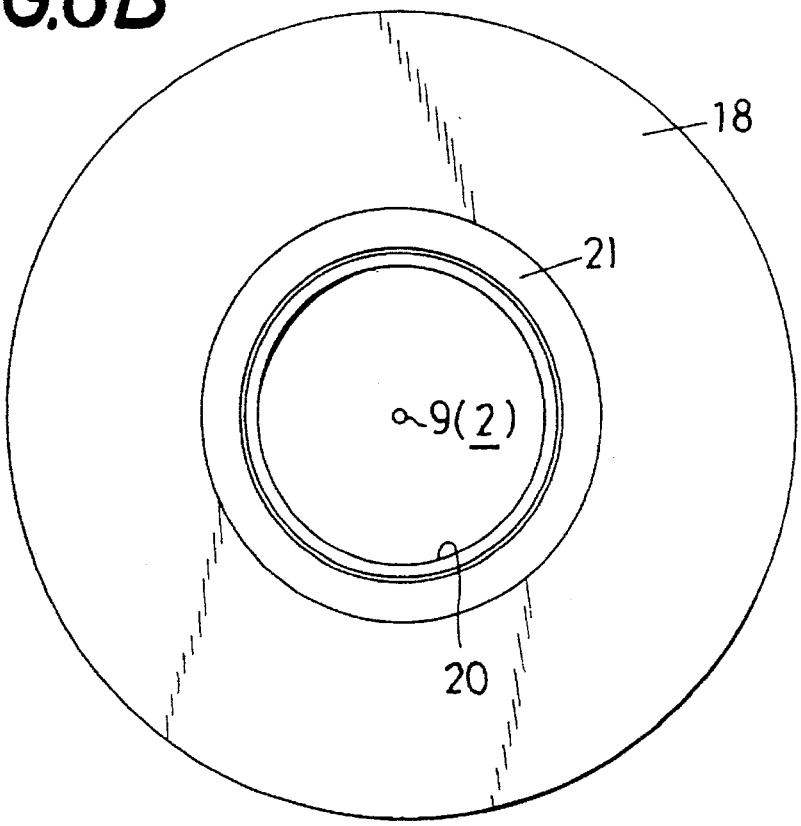
FIG. 6B is a bottom view of the die shown in FIG. 6A and in its entirety.
Figure 9B:
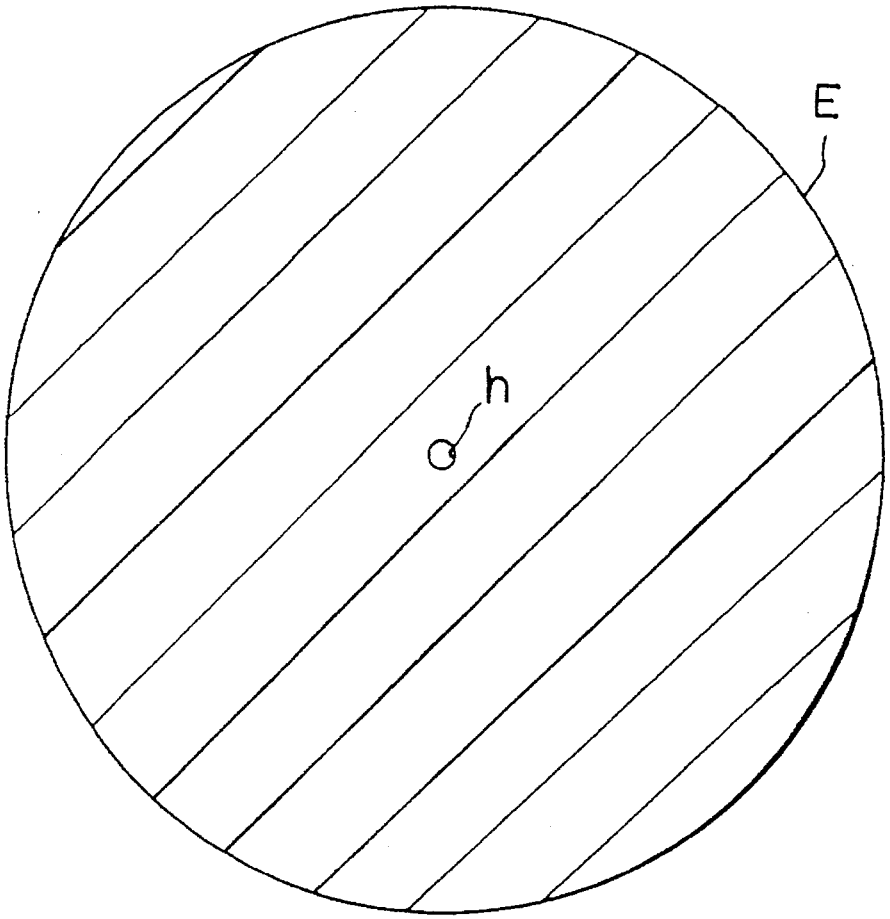

A second embodiment is shown in FIGS. 6A and 6B wherein an extrudate 'E' has the same orifice 'h' as that shown in FIG. 9A in the first embodiment. However, since this extrudate is of a larger diameter as shown in FIG. 9B, the female die 21 having a larger forming hole 20 may be attached to the annular base 18. The female die's forming hole 20 may be modified in its size or shape in any different manner, for example to produce a thinner tube 'E' shown in FIG. 9C.

Figure 7A:
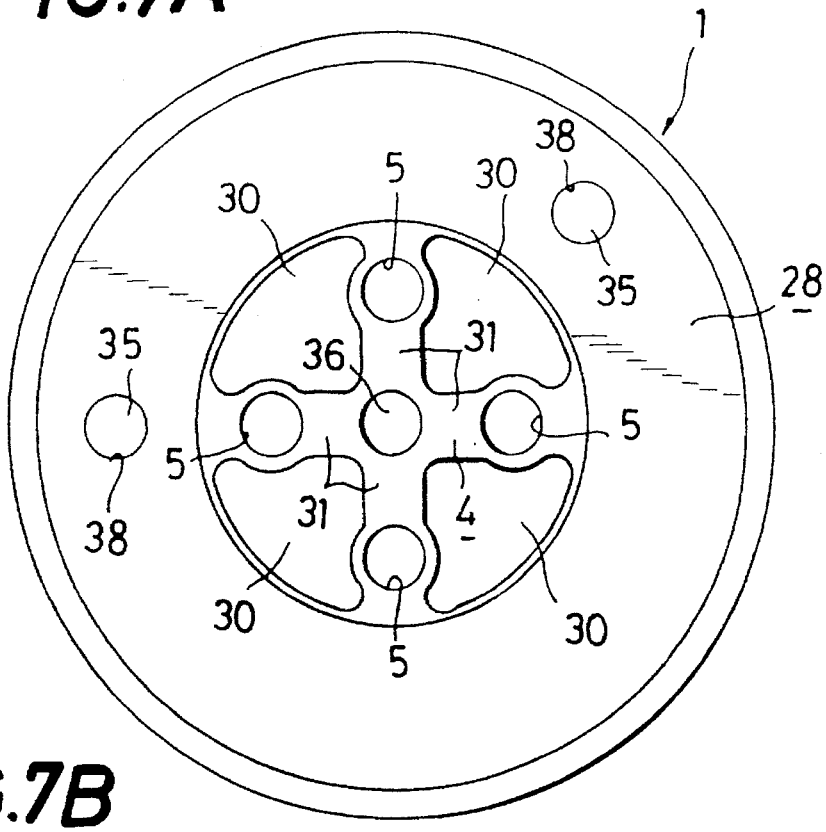
FIG. 7A is a plan view of still another die provided in a third embodiment.
Figure 7B:
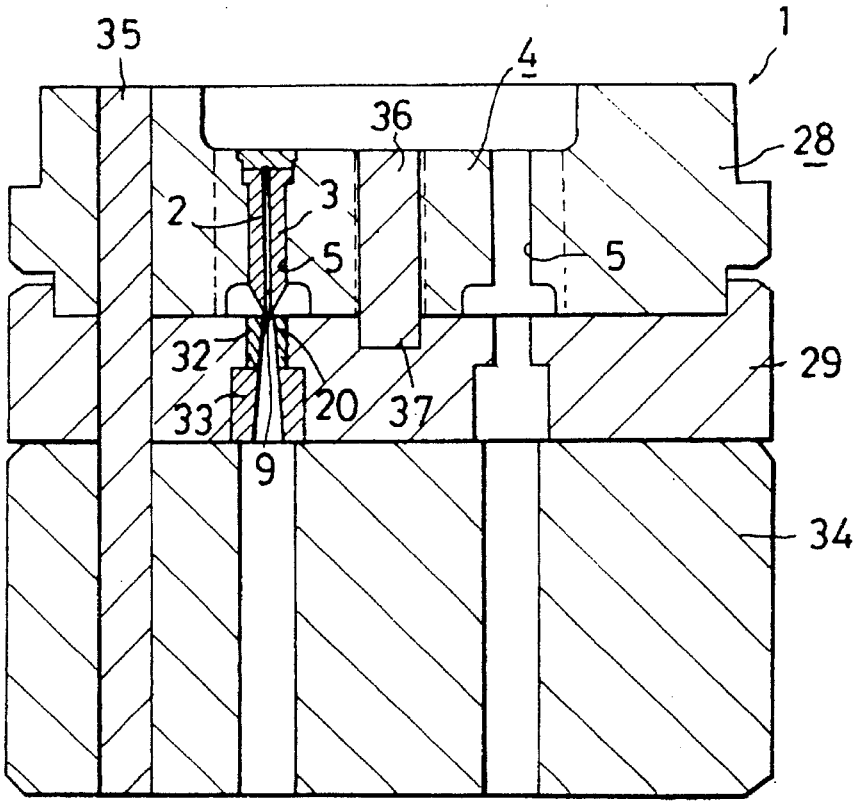
FIG. 7B is a vertical cross section of the die shown in FIG. 7A.
Figure 9C:
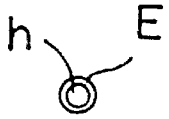
Figure 10:
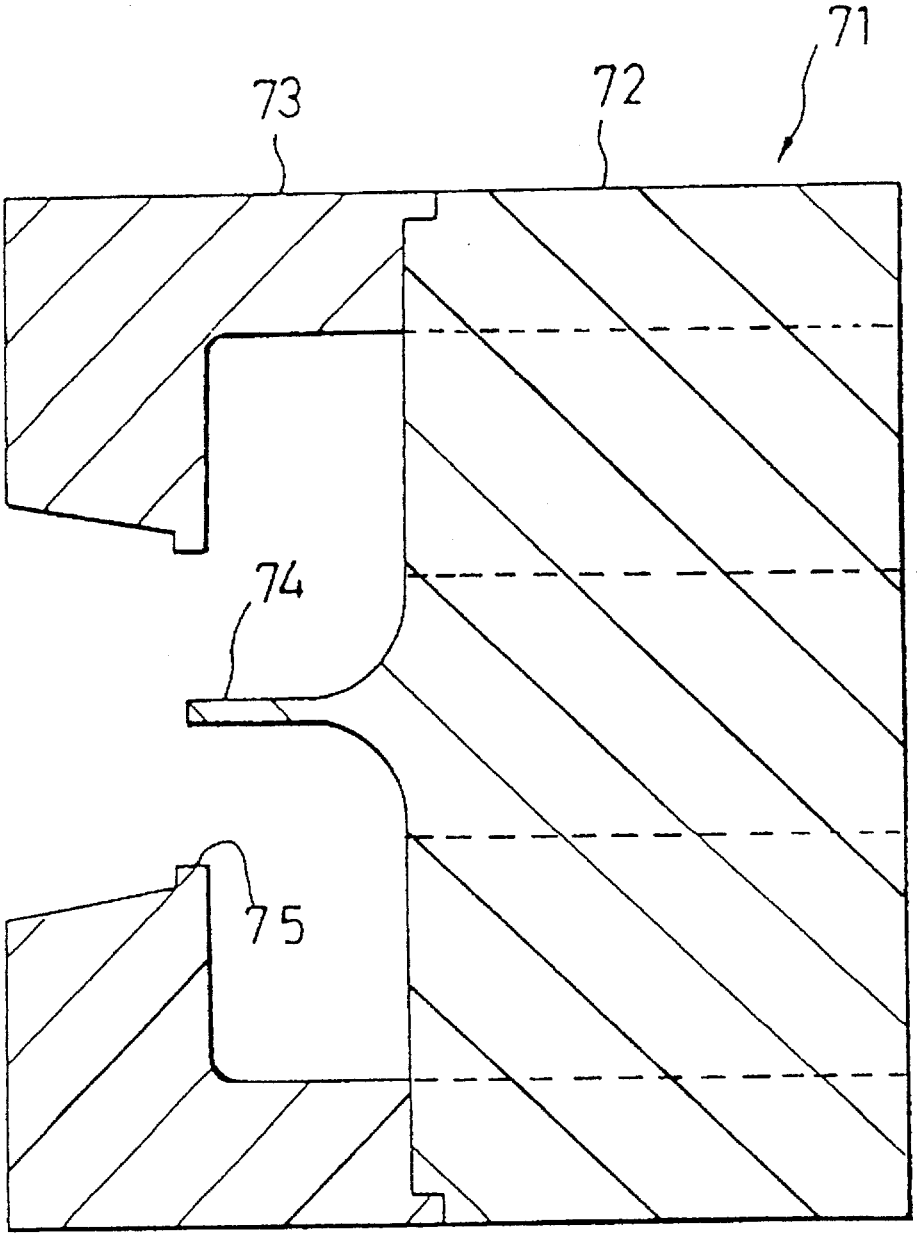
FIG. 10 (Prior Art)
FIG. 10 is a vertical cross section of a prior art die.

In a third embodiment shown in FIGS. 7A and 7B, a die 1 adapted to simultaneously extrude a plurality of fine hollow articles is provided. Each of them 'E', which are for example aluminum fine tubes, has an outer diameter of for instance 1.0 mm and inner diameter (viz. diameter of orifice) of 0.3 mm as shown in FIG. 9C.

The composite die 1 in this case comprises a male die 28 combined with a female die 29 which is supported by a back-up block 34.

Four port holes 30 penetrate a central portion of the male die 28, and an axially extending bore 5 is formed through each bridge portion 31 located between the adjacent port holes 30 and 30. A gripper 3 holding a thin rod-shaped mandrel 2 is placed in each axial bore 5, similarly to the first embodiment. Those members are shrinkage-fitted in or on each other to provide this die with four orifice forming ends 9.

The female die 29 has four forming holes 20 corresponding to the four orifice forming ends 9. The reference numerals 32 and 33 respectively depict four bearing pieces and four back-up pieces. Those pieces 32 and 33 are made of a hard metal or the like hard material and shrinkage-fitted in mandrel holders 4 (viz. the bridge portions of said male die) made of a die steel.

Positioning pins 35 disposed along an outer periphery of this die penetrate it so as to align the male die 28 with the female die 29 and thus to align each orifice-forming end 9 with the corresponding one of the forming holes 20. Additionally, a central columnar pin 36 inserted through a central portion of said male die has an end protruding therefrom to engage with a cylindrical recess 37 formed in an axial portion of the female die. In order to assure a reliable alignment of the male and female dies 28 and 29 with the back-up block 34, apertures 38 for receiving the positioning pins 35 may be formed therethrough by the 'wire cut' or the like method, after they are set in a predetermined place.

It is advantageous that only one or more mandrels which has or have worn out or damaged can be replaced with a new one or new ones, thereby further reducing maintenance cost of the die.

Figure 8B:
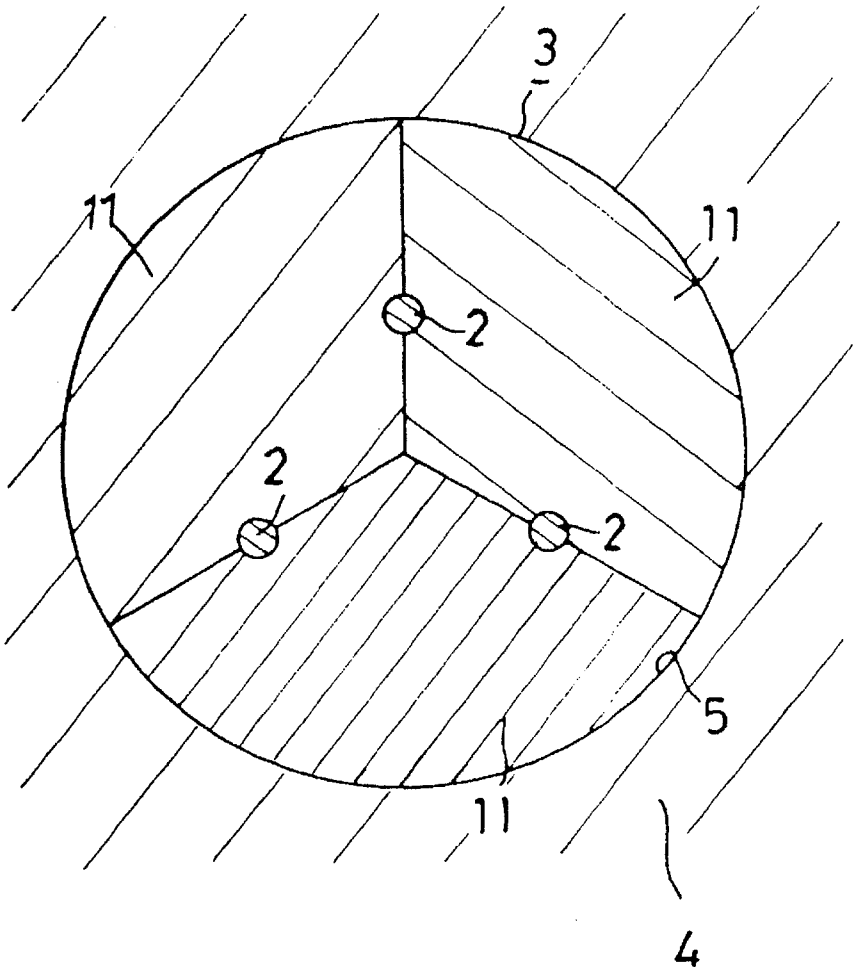
FIG. 8B is a horizontal cross section of the mandrels and relevant members shown in FIG. 8A.
Figure 8A:
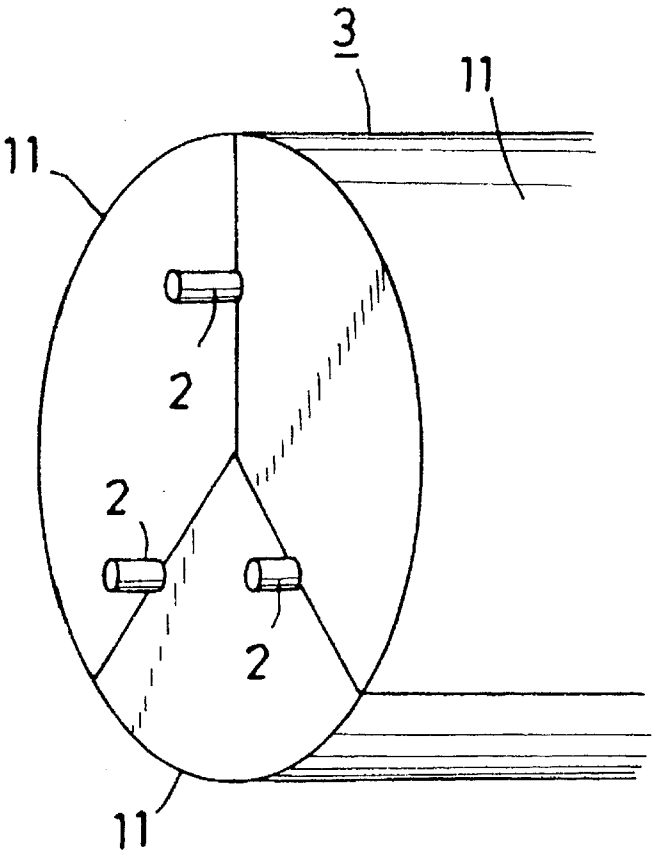
FIG. 8A is perspective view of thin rod-shaped mandrels held in position in a fourth embodiment.

In a fourth embodiment shown in FIGS. 8A and 8B, one gripper 3 comprising three or more segments 11 and holding three or more mandrels 2 is retained in an axial bore 5 of a mandrel holder 4. The axial bore 5 in the die of the present invention may in this manner hold a plurality of thin rod-shaped mandrels 2.

In summary, the mandrel having the orifice forming end is one of discrete constituents of the die. Therefore, the thin rod-shaped mandrel of any desired small diameter defining the orifice can be prepared easily and precisely. In manufacture of such a die, the mandrel tightly surrounded by the gripping segments will be placed at first in the axial bore of the holder, before the inner peripheral surface of the axial bore will be shrinkage-fitted or otherwise fixedly fitted on the outer peripheral surfaces of the gripping segments. Thus, a centripetal force will be imparted to the segments, which will consequently keep the thin rod-shaped mandrel of any small diameter to be integral with the holder. Even if the diameter of the orifice forming portion is extremely small and for example less than 3 mm, the mandrel having such a fine portion can now be prepared easily and precisely.

Maintenance cost for the die of the novel type is reduced, because only the abraded mandrel need be replaced with a new one.

The key pieces secured to the gripper and supported between the annular shoulders facing one another are effective to easily and correctly position the gripper within the axial bore of the mandrel holder, thereby facilitating the manufacture of the die in its entirety.

The sideways lug is effective to position the thin rod-shaped mandrel correctly relative to the gripper, also facilitating the manufacture of the die.

It is preferable in the invention to employ both the positioning mechanisms, one comprising the key pieces and the other comprising the sideways lug, so that the die can be manufactured most easily and most correctly.

What is claimed is:

1. A die for extruding elongated articles each having a longitudinal orifice, comprising:

a male die having an orifice forming portion and a female die having a forming hole, said male die being combined with said female die so as to locate said orifice forming portion within said forming hole, said male die including a thin rod-shaped mandrel being uniform in cross-section over its full length and having a diameter of 3 mm or less, a leading end portion of said thin rod-shaped mandrel constituting said orifice forming portion;

a gripper composed of gripping segments each having a straight groove formed in an inner surface thereof to form a mandrel-gripping bore in said gripper, wherein a diameter of said mandrel-gripping bore is slightly smaller than that of said mandrel so as to fit forcibly and sideways on said thin rod-shaped mandrel at adjustable positions along a direction of an extrusion; and a mandrel holder having an axial bore for receiving and holding said gripper;

wherein said thin rod-shaped mandrel is tightly surrounded and gripped by said gripping segments of said gripper being placed in said axial bore of said mandrel holder with said orifice forming portion protruding a predetermined distance forwardly from said gripper, wherein an inner peripheral surface of said axial bore is shrinkage-fitted, interference-fitted or otherwise fixedly fitted on outer peripheral surfaces of said gripping segments, thereby urging said gripping segments to prevent said thin rod-shaped mandrel from slipping off said gripping segments longitudinally thereof during an extruding process.

2. The die as defined in claim 1, wherein said orifice forming portion of said mandrel is circular in cross section.

3. The die as defined in claim 1, further comprising key pieces each held by and between forward and rearward shoulders, with said forward shoulder facing a rear end of said gripper and formed in said inner peripheral surface of said axial bore, and said rearward shoulder being formed in said outer peripheral surface of each gripping segment and at an intermediate region thereof so as to face a front end of said gripper, whereby said gripper is immovably and correctly positioned in said axial bore.

4. The die as defined in claim 1, wherein said thin rod-shaped mandrel has a lug protruding sideways and resting on a rear end surface of said gripper, thereby correctly positioning said mandrel relative to said gripper.

5. A die for extruding elongated articles each having a longitudinal orifice, comprising:

a male die having an orifice forming portion and a female die having a forming hole, said male die being combined with said female die so as to locate said orifice forming portion within said forming hole, said male die including a plurality of thin rod-shaped mandrels each being uniform in cross-section over its full length and having a diameter of 3 mm or less, a leading end portion of said thin rod-shaped mandrel constituting said orifice forming portion;

a plurality of grippers each composed of gripping segments, each segment having a straight groove formed in an inner surface thereof to form a mandrel-gripping bore in said gripper, wherein a diameter of said mandrel-gripping bore is slightly smaller than that of said thin rod-shaped mandrel so as to fit forcibly and sideways on said thin rod-shaped mandrel at adjustable positions along a direction of an extrusion; and a mandrel holder having a plurality of axial bores for receiving and holding said grippers;

wherein each thin rod-shaped mandrel is tightly surrounded and gripped by said gripping segments of said corresponding gripper being placed in said corresponding axial bore of said mandrel holder with said orifice forming portion protruding a predetermined distance forwardly from said gripper, wherein an inner peripheral surface of each axial bore is shrinkage-fitted or otherwise fixedly fitted on outer peripheral surfaces of said gripping segments, thereby urging said gripping segments to prevent each thin rod-shaped mandrel from slipping off said segments longitudinally thereof during an extrusion process.

6. A die for extruding elongated articles each having two or more longitudinal orifices, comprising:

a male die having an orifice forming portion and a female die having a forming hole, said male die being combined with said female die so as to locate said orifice forming portion within mid forming hole, said male die including a plurality of thin rod-shaped mandrels each being uniform in cross-section over its full length and having a diameter of 3 mm or less, a leading end portion of each thin rod-shaped mandrel constituting said orifice forming portion;

a gripper composed of gripping segments each having straight grooves, each groove formed in an inner surface thereof to form a mandrel-gripping bore in said gripper, wherein a diameter of said mandrel-gripping bore is slightly smaller than that of said mandrel so as to fit forcibly and sideways on said thin rod-shaped mandrels at adjustable positions along a direction of an extrusion; and a mandrel holder having an axial bore for receiving and holding said gripper;

wherein each thin rod-shaped mandrel is tightly surrounded and gripped by said gripping segments of said gripper being placed in said axial bore of said mandrel holder with each orifice forming portion protruding a predetermined distance forwardly from said gripper, wherein an inner peripheral surface of said axial bore is shrinkage-fitted or otherwise fixedly fitted on outer peripheral surfaces of said gripping segments, thereby urging said gripping segments to prevent said thin rod-shaped mandrels from slipping off said segments longitudinally thereof during an extrusion process.

* * * * *